United States Patent [19]

Hackney

[11] 4,335,669

[45] Jun. 22, 1982

[54] SAIL BATTEN IMPROVEMENTS

[76] Inventor: John Hackney, 1026 NW. 16th St., Stuart, Fla. 33494

[21] Appl. No.: 793,087

[22] Filed: May 2, 1977

[51] Int. Cl.[3] ..... B63H 9/04

[52] U.S. Cl. ..... 114/103; 114/218

[58] Field of Search ..... 114/102–105, 114/108–115, 39, 218; 24/117, 130

[56] References Cited

U.S. PATENT DOCUMENTS

| | | | |
|---|---|---|---|
| 2,316,950 | 4/1943 | Goeller | 24/130 |
| 3,026,121 | 3/1962 | Ellam | 114/102 |
| 3,956,785 | 5/1976 | Halfon | 114/218 |
| 4,026,229 | 5/1977 | Winberg | 114/102 |

FOREIGN PATENT DOCUMENTS

| | | | |
|---|---|---|---|
| 639952 | 7/1950 | United Kingdom | 114/103 |
| 1316659 | 5/1973 | United Kingdom | 114/102 |

*Primary Examiner*—George E. A. Halvosa
*Assistant Examiner*—Jesus D. Sotelo
*Attorney, Agent, or Firm*—Carroll F. Palmer

[57] ABSTRACT

Sail battens are provided on their aft end with a jam device to cleat a line passing from the leech of the sail containing such battens to constrain the battens. Such improved battens permit batten compression to be easily adjusted for rapid change of sail draft.

19 Claims, 13 Drawing Figures

FIG 1
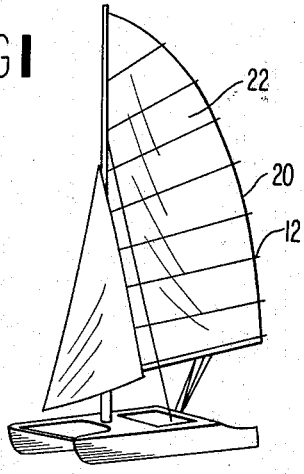
FIG 5
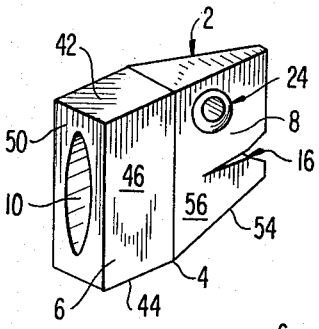
FIG 6
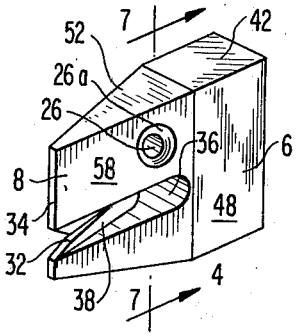
FIG 8
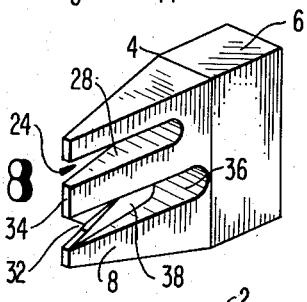
FIG 7
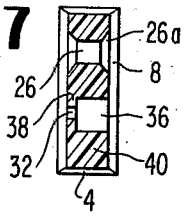
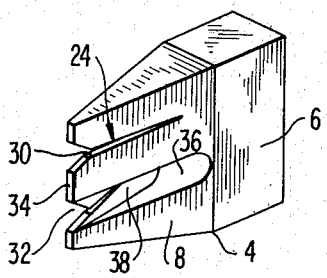
FIG 9
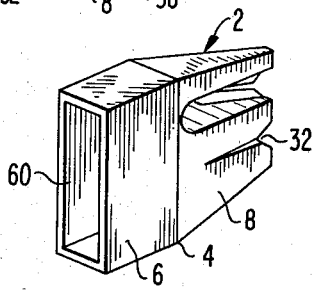
FIG 10
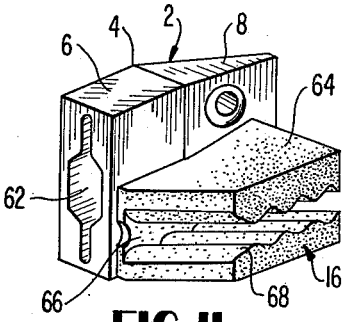
FIG 11
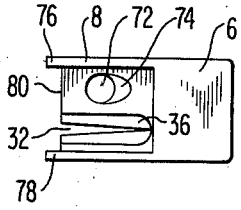
FIG 13
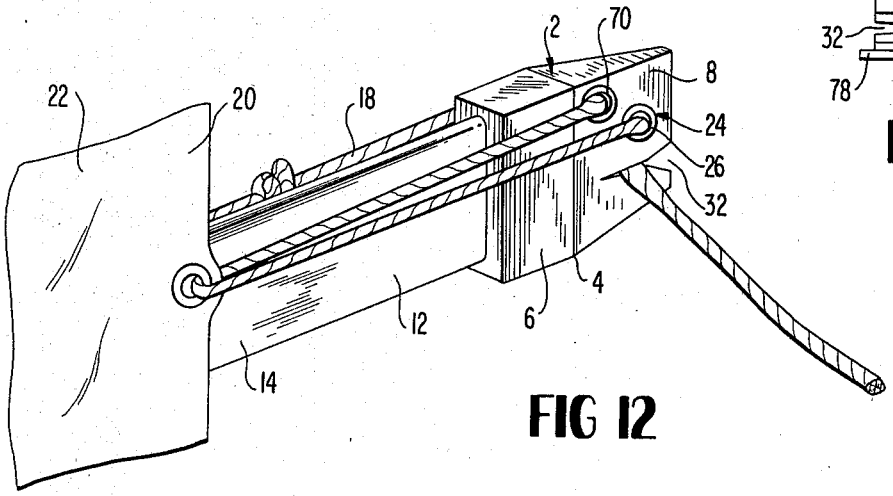
FIG 12

SAIL BATTEN IMPROVEMENTS

BACKGROUND OF THE INVENTION

1. Field of the Invention

This invention relates broadly to improvements in sail battens. More particularly, it concerns novel sail batten constraining devices, improved sail battens comprising such devices and batten-sail combinations using such improved sail battens.

2. Description of the Prior Art

Battens are extensively used with sails for sailcraft, e.g., sailboats, iceboats, wind propelled scooters, etc., to support and/or shape the sails. The sails with which battens are used include lugsails, lateen sails, square-rigged sails, jib-headed (Marconi rig) sails and gaff rig sails. This invention pertains primarily to battens for jib-headed sails.

Jib-headed sails may be divided into several classes with respect to battens, namely, unbattened sails, partial batten sails and full battened sails. Jib-headed sails made without roach do not require batten support for the leach and, hence, are usually unbattened. This type of sail is used on cruising sailboats, small sailing dinghies and other sailcraft where high performance sail qualities are not required.

In racing sailboats, iceboats and other racing sailcraft, high performance is demanded for the sails. Most such sails are formed with substantial roach that require battens for support to provide proper leech shape. The partial batten type sails use a plurality of battens that are carried in pockets extending forward from the leech only a minor length of their chords of the sail. In contrast, the full batten type sails use a plurality of battens that are carried in pockets that extend all the way from the leech to the luff of the sail at spaced intervals between the foot and head of the sail. The full type battens are longer than their respective pockets and by compressing such battens in their pockets between the sail luff and leech, the battens can be caused to bow. Such compression is usually produced by tieing lines fastened to the sail leech across the aft ends of the battens. The tighter the lines are tied, the greater the compression on the batten and the larger the bow.

Substantially all jib-headed sails are formed with draft, i.e., the sails are not flat, but present a outward curvature to leeward in use. Sails of the full batten type obviously require much more pocket and batten material for a given size sail than do the partial batten type. Nevertheless, they are used with many types of sailcraft because a greater amount of sail draft can be produced with them than can be attained with partial batten or unbattened sails.

In the use of a sailcraft equipped with full batten sails, it may be desireable from time to time to change the draft of a sail by changing batten compression. This can be tedious and time consuming with batten constructions currently available. The available battens also can present problems in removing them from their pockets such as when the sails are taken off the sailcraft for folding and storage.

OBJECTS

A principal object of this invention is the provision of improvements in sail battens. Further objects include the provision of:

(1) New sail batten constraining devices, (2) Improved forms of sail battens, particularly for full batten sails, comprising such new constraining devices, (3) Novel sail batten pocket and sail batten combinations, (4) Improved forms of full batten sails.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the present invention by the provision of sail battens provided on their aft end with jam means to cleat a line passing from the leech of the sail containing such battens to constrain the battens.

The objects are further accomplished by the provision of sail batten constraining devices that comprise a body member having a fore portion, an aft portion integral with the fore portion, a recess in said fore portion to receive the end of a sail batten and jam means to cleat a line passed from the leech of a sail to the device.

Additionally, the invention objects are accomplished by provision of (a) new sail battens having the constraining devices as described fixed to their aft ends, (b) combinations of sail pockets and such new sail battens and (c) sails equipped with such sail pocket-batten combinations.

Advantageously, the new constraining devices have at least one transverse opening in their aft portion through which a line from one side of the leech of a sail may be passed to the other side of the sail. Further, the jam means for the constraining devices comprises a tapered slot which extends from the end of the aft portion of the device toward said fore portion and a U-shaped cavity in the aft portion of greater width than the tapered slot is juxtaposed to the tapered slot.

BRIEF DESCRIPTION OF THE DRAWINGS

A more detailed understanding of the new devices of the invention and their method of use may be had by reference to the accompanying drawings in which:

FIG. 1 is a schematic prospective view of a catamaram sailboat equipped with a mainsail containing new battens of the invention.

FIG. 5 is an isometric view of one form of sail batten constraining device of the invention viewed from the fore end thereof.

FIG. 6 is an isometric view of the device of FIG. 5 from the aft end thereof.

FIG. 7 is a sectional view taken on the line 7—7 of FIG. 6.

FIG. 8 is an isometric view from the aft end of another embodiment of a sail batten constraining device of the invention.

FIG. 9 is an isometric view from the aft end of yet another embodiment of a sail batten constraining device of the invention.

FIG. 10 is an isometric view from the fore end of the device of FIG. 9.

FIG. 11 is an isometric view from the fore end of another embodiment of the invention.

FIG. 12 is a fragmentary, isometric view of a sail equipped with a modified form of batten of the invention.

FIG. 13 is a starboard side view of another embodiment of the invention.

DESCRIPTION OF THE PREFERRED EMBODIMENTS

Figure 2:
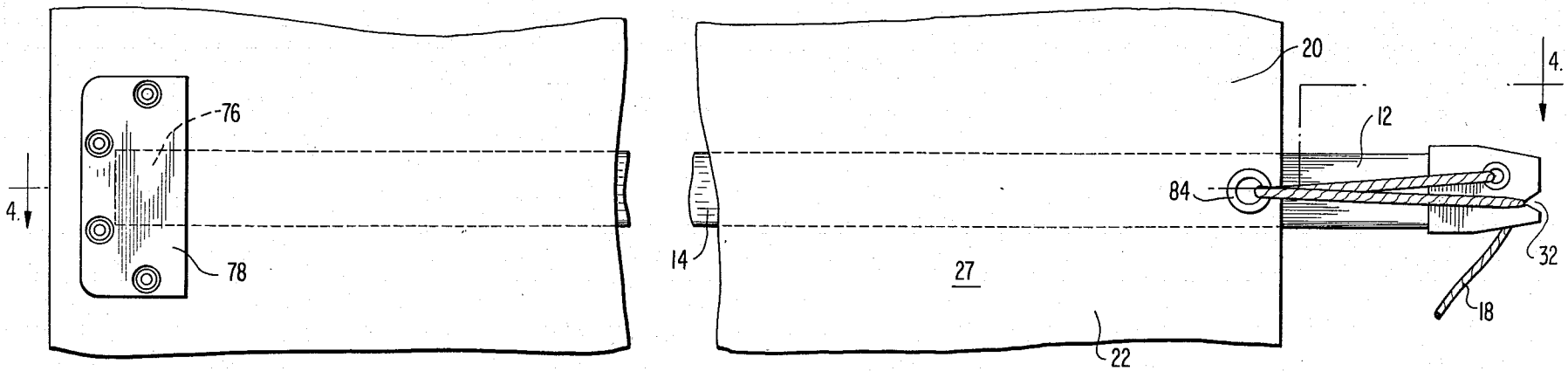
FIG. 2 is a fragmentary, port side, plan view of a full batten sail equipped with new battens of the invention.

Referring to the drawings in detail, a sail batten constraining device 2 of the invention comprises a body member 4 having a fore portion 6, an aft portion 8 integral with the fore portion 6, a recess 10 in the fore portion to receive the end 12 of the sail batten 14 and jam means 16 to cleat a line 18 passed from the leech 20 of the sail 22.

The aft portion 8 of the member 4 includes a transverse opening 24 through which the line 18 may be passed from the starboard side 25 to the port side 27 of the sail 22. In the embodiments of the invention shown in FIGS. 2–7, 11 and 12, the transverse opening 24 is a hole 26 with chamfered ends 26*a*. In the embodiment of FIG. 8, the transverse opening 24 is a U-shaped slot 28, while in the embodiment of FIGS. 9 and 10 the opening 24 is a tapered slot 30.

The preferred form of jam means 16 of the devices 2 comprise a tapered slot 32 which extends from the end 34 of the aft portion 8 toward the fore portion 6. A U-shaped cavity 36 is formed in the aft portion 8, the cavity 36 being juxtaposed to the tapered slot 32 so that the wall portion 38 of the aft portion 8 that defines the slot 32 is appreciably thinner than the total cross-section 40 of the aft portion 8. The width and depth of the cavity 36 are substantially greater than that of the greatest extremities of the tapered slot 32.

The fore portion 6 of body member 4 has a rectangular longitudinal cross-section and is defined by a top 42, bottom 44, port side 46, starboard side 48 and fore end 50. The aft portion 8 has a trapazodial longitudinal cross-section and is defined by top 52, bottom 54, port side 56, starboard side 58 and aft end 34. The top 52 and bottom 54 taper toward the end 34 so that the aft portion 8 is trapazodial in horizontal cross-section.

In the device 2 of FIG. 5 the batten receiving recess 10 is elliptical in shape, while the device of FIG. 10 has a rectangular shaped recess 60 and the device of FIG. 11 has a complex shaped recess 62. Such recesses may take any shape necessary to snuggly envelope the end 12 of the batten 14 as such battens may be varied in cross-section by different manufacturers. If a universal form of device 2 is desired, the recess in the fore portion 6 may be as recess 60 and cement may be used to fill any space existing in the recess after the batten end 12 is inserted.

In the form of device 2 shown in FIG. 11, the jam means 16 comprises a lug portion 64 extending from a side of the body member 4 and having a tapered slot 66 defined by opposed serrations 68. In use, a line (not shown in FIG. 11) will be cleated in jam means slot 66 is opposed to cleating in a slot 32 as shown in FIGS. 2–4 and 12.

In the form of device 2 shown in FIG. 12, there is a second hole 70 in addition to the first hole 26 for passage therethrough of the line 18. This arrangement together with an extra grommet (not shown) in the leech of the sail 22 on the starboard side permits a 4 to 1 purchase for the line 18 enabling higher compressive force to be applied to the batten 14 for the same pull applied to the free end of line 18 as compared to the 3 to 1 purchase for the line 18 with the single hole embodiment as shown in FIGS. 2–7 and 11.

Figure 3:
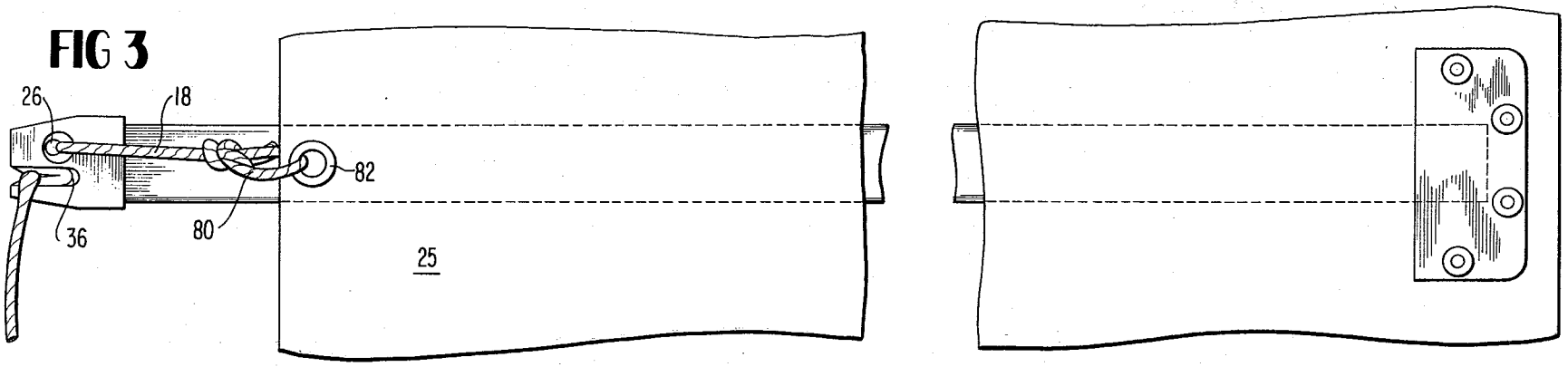
FIG. 3 is a fragmentary, starboard side, plan view of the sail shown in FIG. 2.
Figure 4:
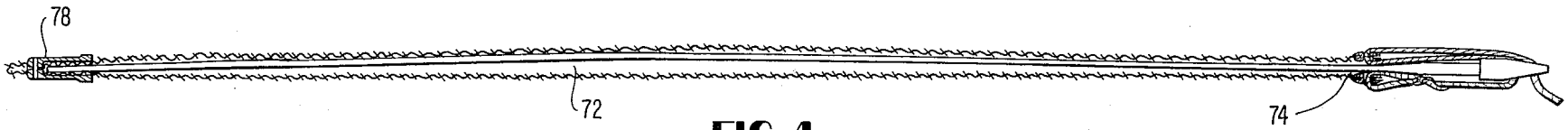
FIG. 4 is a sectional view taken on line 4—4 of FIG. 2.

In use of a full batten sail 22 in accordance with the invention, the batten 14 is inserted into the batten pocket 72 through the leech opening 74 until the fore end 76 of the batten 14 abuts the pocket luff guard 78. The bitter end 80 of the line 18 is fixed such as by knotting to the grommet 82 on one side of the sail, e.g., the starboard side as shown in FIG. 3. The line is next passed through hole 26, then through second grommet 84 and finally into the tapered slot 32 for cleating. The bitter end 80 should preferably be tied in that side of the sail so that the free end of the line 18 after cleating can lie in the cavity 36 as shown in FIG. 3. By controlling the pulling force applied to line 18 before cleating in slot 32, the amount of bow forced into the batten 14, and in turn the draft imposed in the sail 22, may be controlled.

The U-shaped cavity 36 serves to prevent the wind from forcing the line 18 out of the tapered slot 32. The exact mechanism responsible for this effect is not known, but it has been found that if the jam means slot 32 has this juxtaposed cavity 36, the line 18 is more reliably cleated by the jam means 16 than if the cavity 36 is not present.

The form of device 2 shown in FIGS. 9 and 10 may be used with a single line in the manner described above. Alternatively, this double tapered slot embodiment may use two separate lines (not shown), one extending from the grommet on one side of the sail and the other line extending from the other grommet. However, this looses the mechanical advantage effect of the multiple purchase arrangement of a single line.

The sail batten constraining devices shown in FIGS. 2–12 may be used with any type sail, but are preferred for use with full batten mainsails. The device shown in FIG. 13, in contrast, is designed for preferred use with jib battens. This embodiment comprises aft portion 6, fore portion 8, tapered slot 32 and U-shaped cavity 36. The transverse hole 72 is beveled at its fore end 74. The device of FIG. 13 is distinguished by the upper lug 76 and lower lug 78 which serve to protect the aft end 80, slot 32 and any line contained therein from chaffing on the mast or shrouds when the jib moves across the boat during tacking.

The embodiment of the invention in which an exclusive property or privilege is claimed are defined as follows:

1. A sail batten provided on the aft end with jam means to cleat a line passing from the leech of the sail containing the batten to constrain the batten.

2. A sail batten constraining device comprising a body member having a fore and an aft portion, means on said fore portion to attach said device to the end of a sail batten and jam means on said aft portion to cleat a line passed from the leech of a sail to said device.

3. The device of claim 2 wherein said aft portion includes a transverse opening through which a line from one side of the leech of a sail may be passed to the other side of the sail leech.

4. The device of claim 3 wherein said transverse opening is a slot extending from the end of said aft portion toward said fore portion and said jam means comprises a tapered slot extending from the end of said aft portion toward said fore portion.

5. The device of claim 4 wherein said transverse opening slot is U-shaped.

6. The device of claim 4 wherein said transverse opening slot is tapered and comprises a second jam means in said device.

7. The device of claim 3 wherein said transverse opening is a hole through said aft portion.

8. The device of claim 7 wherein there is a single transverse hole and a single tapered slot.

9. The device of claim 7 wherein there are a pair of transverse holes through said aft portion.

10. A sail batten constraining device comprising a body member having a fore portion and an aft portion integral with said fore portion, means on said fore portion to attach said device to the end of a sail batten and jam means comprising a tapered slot which extends from the end of said aft portion toward said fore portion to cleat a line passed from the leech of a sail to said device.

11. The device of claim 10 wherein said fore portion has a recess to receive the end of a sail batten.

12. The device of claim 10 wherein said fore portion has a rectangular longitudinal cross-section and said aft portion has a trapozodial longitudinal cross-section.

13. A sail batten provided on an end thereof with a sail batten constraining device comprising a body member having a fore portion and an aft portion integral with said fore portion, means attaching said fore portion to said batten end and jam means comprising a tapered slot which extends from the end of said aft portion toward said fore portion to cleat a line passed from the leech of a sail into which said batten is installed to said constraining device.

14. A full batten sailcraft sail comprising:

a sail batten pocket, a first grommet in the leech of the sail on one side of said pocket, a second grommet in the leech of the sail on the side of said pocket opposed to said first grommet, a sail batten installed in said pocket, said batten having its aft end extending beyond the aft end of said pocket, said batten aft end having attached thereto a sail batten constraining device having a fore portion and an aft portion, said aft portion comprising a transverse opening and jam means including a tapered slot which extends from the end of said aft portion toward said fore portion, a line fixed at one end through said first grommet, said line passing through said transverse opening, thence through said second grommet and finally into said jam means.

15. An end cap for a sail between comprising a body member having a fore portion and an aft portion integral with said fore portion, means on said fore portion to attach said cap to the aft end of a sail batten, jam means comprising a tapered slot which extends from the aft end of said aft portion toward said fore portion to cleat a line passed from the leech of a sail to said cap and a U-shaped cavity of width greater than the width of said tapered slot formed in one side only of the aft portion of said cap and extending longitudinally alongside said tapered slot.

16. The end cap of claim 15 wherein said aft portion thereof includes a transverse opening separate from said tapered slot and U-shaped cavity through which a line from one side of the leech of a sail may be passed to the other side of the sail leech.

17. The end cap of claim 16 wherein said transverse opening is a hole.

18. The end cap of claim 16 wherein said transverse opening is a tapered slot extending from the aft end of said aft portion toward said fore portion.

19. The end cap of claim 16 wherein said transverse opening is a U-shaped slot extending from the aft end of said aft portion toward said fore portion.

* * * * *

UNITED STATES PATENT AND TRADEMARK OFFICE

CERTIFICATE OF CORRECTION

PATENT NO. : 4,335,669

DATED : June 22, 1982

INVENTOR(S) : JOHN HACKNEY

It is certified that error appears in the above—identified patent and that said Letters Patent is hereby corrected as shown below:

Column 3, line 67 change "is" to --as--.

Column 6, line 17 change "between" to --batten--.

Signed and Sealed this

*Seventeenth* Day of *May 1983*

[SEAL]

*Attest:*

DONALD J. QUIGG

*Attesting Officer*

*Acting Commissioner of Patents and Trademarks*